US009352186B2

(12) United States Patent
Watterson

(10) Patent No.: US 9,352,186 B2
(45) Date of Patent: May 31, 2016

(54) TREADMILL WITH SELECTIVELY ENGAGEABLE DECK STIFFENING MECHANISM

(71) Applicant: ICON Health & Fitness, Inc., Mendon, UT (US)

(72) Inventor: Scott R. Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 81 days.

(21) Appl. No.: 13/856,940

(22) Filed: Apr. 4, 2013

(65) Prior Publication Data

US 2013/0267387 A1 Oct. 10, 2013

Related U.S. Application Data

(60) Provisional application No. 61/620,442, filed on Apr. 5, 2012.

(51) Int. Cl.
*A63B 22/02* (2006.01)
*A63B 71/06* (2006.01)

(52) U.S. Cl.
CPC ..... *A63B 22/02* (2013.01); *A63B 22/0214* (2015.10); *A63B 22/0228* (2015.10); *A63B 71/0622* (2013.01); *A63B 2071/0638* (2013.01)

(58) Field of Classification Search
CPC ..... A63B 22/02; A63B 22/0207; A63B 22/0214; A63B 22/0221; A63B 22/0228
USPC ..... 482/51, 54, 66, 68, 74, 78, 79, 142, 148
See application file for complete search history.

(56) References Cited

U.S. PATENT DOCUMENTS

| | | | | |
|---|---|---|---|---|
| 5,279,528 | A | 1/1994 | Dalebout et al. | |
| 5,336,144 | A * | 8/1994 | Rodden | 482/54 |
| 5,441,468 | A | 8/1995 | Deckers et al. | |
| 5,976,061 | A * | 11/1999 | Moon et al. | 482/54 |
| 6,174,267 | B1 | 1/2001 | Dalebout et al. | |
| 6,174,268 | B1 * | 1/2001 | Novak | 482/54 |
| 6,786,852 | B2 | 9/2004 | Watterson et al. | |
| 7,163,493 | B1 * | 1/2007 | Kuo | 482/54 |
| 7,563,205 | B2 | 7/2009 | Alling | |
| 7,628,733 | B2 | 12/2009 | Donner et al. | |
| 2001/0024998 | A1 * | 9/2001 | Novak et al. | 482/54 |
| 2002/0010055 | A1 * | 1/2002 | Dyer et al. | 482/54 |
| 2002/0045518 | A1 * | 4/2002 | Dalebout et al. | 482/51 |
| 2003/0139261 | A1 * | 7/2003 | Kuo | 482/54 |
| 2003/0153434 | A1 * | 8/2003 | Dalebout et al. | 482/54 |
| 2004/0242378 | A1 * | 12/2004 | Pan et al. | 482/54 |
| 2007/0015635 | A1 * | 1/2007 | Donner et al. | 482/54 |
| 2009/0036272 | A1 * | 2/2009 | Yoo | 482/7 |
| 2009/0088301 | A1 * | 4/2009 | Alling | 482/54 |
| 2009/0181829 | A1 * | 7/2009 | Wu | 482/54 |

* cited by examiner

*Primary Examiner* — Oren Ginsberg
*Assistant Examiner* — Gary D Urbiel Goldner
(74) *Attorney, Agent, or Firm* — Holland & Hart LLP

(57) ABSTRACT

A treadmill includes an impact absorption mechanism operatively positioned at least in part between a deck and a base frame of the treadmill so that the impact absorption mechanism enables the deck to move relative to at least a portion of the base frame during impact events on the deck and a selectively engageable deck stiffening mechanism that reduces the amount of movement of at least a portion of the deck relative to the base frame during impact events on the deck. The deck stiffening mechanism includes one or more generally rigid members and an engaging mechanism. The engaging mechanism selectively engages the one or more generally rigid members with the deck to provide support to the deck during impact events on the deck.

15 Claims, 6 Drawing Sheets

TREADMILL WITH SELECTIVELY ENGAGEABLE DECK STIFFENING MECHANISM

CROSS-REFERENCE TO RELATED APPLICATIONS

This application claims priority to U.S. Provisional Patent Application No. 61/620,442 filed Apr. 5, 2012.

TECHNICAL FIELD

This disclosure relates generally to systems, methods, and devices for exercise. More particularly, the disclosure relates to treadmills having one or more generally rigid members that are selectively engageable with a treadmill deck to provide an exercise surface that more realistically simulates a generally inflexible surface.

BACKGROUND

Treadmills have become very popular for use in improving health and fitness. Many commercially available treadmills include an endless belt that rotates about rollers at each end. The belt may travel across a deck surface that is supported by a frame member. The deck may provide a generally rigid surface. The impact of an individual's feet on a generally rigid surface may create various injuries such as "shin splints" and other leg related problems. Thus, many commercially available treadmills include a cushioning mechanism that dampens the impact force of an exerciser's feet on the deck during an exercise session on the treadmill. Many cushioning mechanisms that may be used to dampen the impact force of a user's feet are well known. Examples of various deck cushioning mechanisms are described in U.S. Pat. Nos. 5,441,468, 7,628,733, 5,279,528, 6,786,852, 7,563,205, and 6,174,267.

While systems that cushion or dampen the impact force of a user's feet on a treadmill deck may help to avoid some injuries, there may be times when an individual prefers to walk, run, or jog on a treadmill deck that is rigid and inflexible. For example, some individuals may use a treadmill to train or otherwise prepare for a race, marathon, or other event that is to occur on a surface that is rigid and generally inflexible, such as cement or pavement. For these individuals, training on treadmill having a generally rigid and inflexible deck may help the individual to prepare his or her body for the actual conditions that will be encountered during the event. On the other hand, training on a treadmill having a cushioned and flexible deck may render the individual not only unprepared for the event but more susceptible to injury during the event.

SUMMARY OF THE INVENTION

In one example embodiment of the present invention, a treadmill includes a base frame having a pair of side frame members and a pair of rotatable pulleys secured to and extending between the side frame members. An endless belt is trained over the rotatable pulleys and has an upwardly exposed exercise section. A deck is secured to the base frame and provides support to the upwardly exposed exercise section of the belt. An impact absorption mechanism is operatively positioned at least in part between the deck and the base frame. The impact absorption mechanism enables the deck to move relative to at least a portion of the base frame during impact events on the deck. A selectively engageable deck stiffening mechanism reduces the amount of movement of at least a portion of the deck relative to the base frame during impact events on the deck. The deck stiffening mechanism includes one or more generally rigid members and an engaging mechanism. The engaging mechanism selectively engages the one or more generally rigid members with the deck to provide support to the deck during impact events on the deck.

In another aspect that may be combined with any of the aspects herein, the impact absorption mechanism comprises one or more cushioning members.

In another aspect that may be combined with any of the aspects herein, the one or more cushioning members are made from rubber or foam.

In another aspect that may be combined with any of the aspects herein, the one or more generally rigid members are made of plastic, metal, or wood.

In another aspect that may be combined with any of the aspects herein, the deck stiffening mechanism comprises at least two generally rigid members.

In another aspect that may be combined with any of the aspects herein, the engaging mechanism comprises a handle and an axle that interconnects the at least two generally rigid members and the handle.

In another aspect that may be combined with any of the aspects herein, movement of the handle engages and disengages the at least two generally rigid members with the deck.

In another aspect that may be combined with any of the aspects herein, rotation of the handle selectively engages and disengages the at least two generally rigid members below the deck.

In another aspect that may be combined with any of the aspects herein, the deck stiffening mechanism comprises at least two independently operable generally rigid members.

In another aspect that may be combined with any of the aspects herein, the engaging mechanism comprises a motor in electric communication with an input device.

In another aspect that may be combined with any of the aspects herein, the one or more generally rigid members may be selectively engaged or disengaged in response to inputs received at the input device.

In another aspect that may be combined with any of the aspects herein, the treadmill includes a control console with one or more input devices.

In another aspect that may be combined with any of the aspects herein, the control console includes a display screen that displays an indicator to indicate whether the one or more generally rigid members are engaged or disengaged with the deck.

In another aspect that may be combined with any of the aspects herein, the indicator comprises a light that illuminates when the one or more generally rigid members are engaged with the deck.

In another aspect that may be combined with any of the aspects herein, the indicator comprises a word or words that provide information regarding whether the one or more generally rigid members are engaged or disengaged with the deck.

In another aspect that may be combined with any of the aspects herein, the treadmill includes at least two deck stiffening mechanisms that can be selectively engaged and disengaged independently of each other.

In another aspect that may be combined with any of the aspects herein, the treadmill includes a motor in mechanical communication with the pair of rotatable pulleys.

In another aspect that may be combined with any of the aspects herein, a treadmill includes a flexible deck secured to side frame members and positioned between rotatable pulleys, wherein the deck flexes during impact events.

In another aspect that may be combined with any of the aspects herein, the deck provides support to the upwardly exposed exercise section of a belt.

In another aspect that may be combined with any of the aspects herein, a selectively engageable deck stiffening mechanism reduces the flexing of the deck during impact events.

In another aspect that may be combined with any of the aspects herein, the deck stiffening mechanism includes one or more generally rigid members attached to an engaging mechanism.

In another aspect that may be combined with any of the aspects herein, the engaging mechanism selectively positions the generally rigid member below and in contact with the deck to provide support to the deck during impact events on the deck.

In another aspect that may be combined with any of the aspects herein, the one or more generally rigid members comprise at least one generally rigid member that extends substantially the entire distance between the pair of side frame members.

In another aspect that may be combined with any of the aspects herein, the engaging mechanism selectively positions at least one generally rigid member below the deck at a point that is approximately equidistant from the side frame members.

In another aspect that may be combined with any of the aspects herein, the engaging mechanism comprises a motor in electric communication with an input device, wherein the one or more generally rigid members may be selectively engaged or disengaged in response to inputs received at the input device.

In another aspect that may be combined with any of the aspects herein, a treadmill includes a control console with an input device.

In another aspect that may be combined with any of the aspects herein, an input device comprises a button.

DETAILED DESCRIPTION

Figure 1:
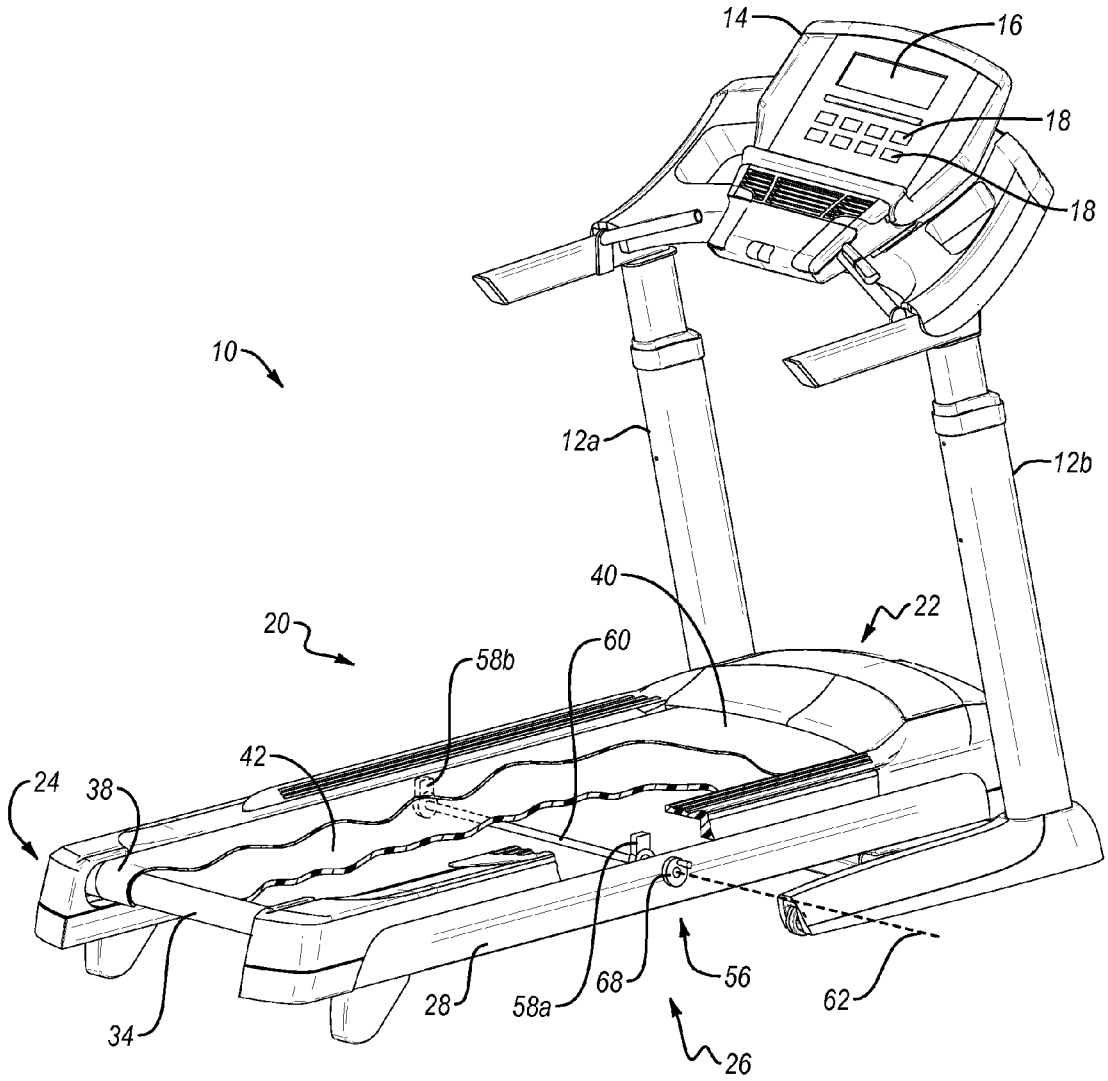
FIG. 1 is a partial cutaway perspective view of a treadmill with one embodiment of a selectively engageable deck stiffening mechanism.
Figure 2:
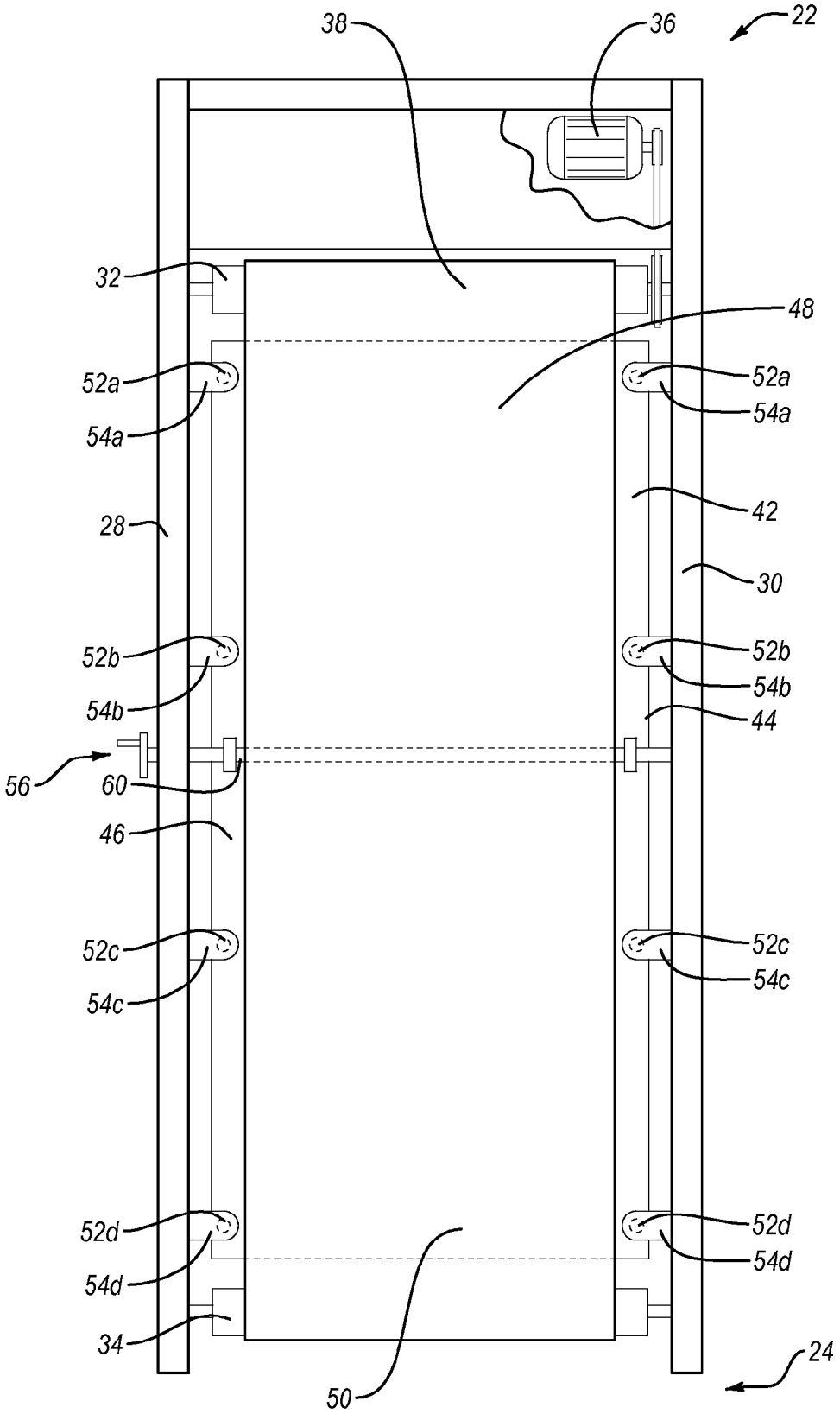
FIG. 2 is a bottom view of the treadmill illustrated in FIG. 1.

Depicted in FIGS. 1 and 2 is one embodiment of a treadmill 10 incorporating features of the present invention. Treadmill 10 includes upright frame portions 12*a* and 12*b*, which provide support to a control console 14. Control console 14 can include one or more output devices that are configured to present information to a user. For example, control console 14 includes a display screen 16. Control console can also include one or more input devices that are configured to receive information from a user. For example, control console 14 includes buttons 18.

Treadmill 10 also includes a tread base 20 which may be connected to upright frame portions 12*a* and 12*b*. Tread base 20 has a forward end 22 and a rearward end 24. Tread base 20 includes a base frame 26, which includes a right side frame member 28 and a left side frame member 30. In FIG. 1, certain portions on the right side of tread base 20 are cut away so that internal components can be seen. FIG. 2 illustrates a bottom view of tread base 20, where certain components of tread base 20, which are not visible in FIG. 1, may be seen.

Right frame member 28 and left frame member 30 are in a spaced-apart, longitudinal relationship and are substantially parallel to each other. Right frame member 28 and left frame member 30 each generally extend between the forward end 22 and rearward end 24 of tread base 20. Tread base 20 also includes a front rotatable pulley 32 and a back rotatable pulley 34. Rotatable pulleys 32 and 34 are secured to and extend between side frame members 28 and 30. Front rotatable pulley 32 is positioned at or near the forward end 22 of tread base 20. Back rotatable pulley 34 is positioned at or near the rearward end 24 of tread base 20. Like side frame members 28, 30, rotatable pulleys 32, 34 are substantially parallel to each other. However, side frame members 28, 30 and rotatable pulleys 32, 34 are positioned in a substantially perpendicular orientation relative to one another. Tread base 20 may also house a motor 36 that is in mechanical communication with one or both of rotatable pulleys 32, 34. For example, motor 36 may cause one or both of rotatable pulleys 32, 34 to rotate.

Tread base 20 further includes an endless belt 38 that is trained over pulleys 32, 34. Rotation of one or both of rotatable pulleys 32, 34 may cause endless belt 38 to move. Endless belt 38 includes an upwardly exposed exercise section 40 (FIG. 1) upon which a user may walk, jog, or run during operation of treadmill 10.

Tread base 20 also includes a deck 42 that may be secured, either directly or indirectly, to base frame 26. Deck 42 includes a left side 44, a right side 46, a forward end 48, and a rearward end 50. Deck 42 is positioned to extend below exercise section 40 of belt 38 and provide support to a user exercising thereon. Deck 42 may be constructed from a number of different materials, including wood, plastic, metal, composite materials, and the like. Depending on the material used, deck may be substantially rigid or it may be flexible.

Deck 42 may be configured to move, at least in part, relative to base frame 26 during an impact event on deck 42. An impact event may include the foot falls of a person walking, jogging, or running on exercise section 40 of belt 38. Specifically, all or part of deck 42 may move in a downward direction during an impact event to provide a softer feel for the person walking, jogging, or running on deck 42. This may reduce the stress that impact events may have on the person's body, specifically his or her feet and legs.

For example, deck 42 may be allowed to move relative to base frame 26 via an impact absorption mechanism. Optionally, an impact absorption mechanism may be positioned at least partially between deck 42 and base frame 26. An impact absorption mechanism may dampen impact events by compressing during the impact event, thereby absorbing the impact forces. An impact absorbing device may comprise a spring, or a compressible material including but not limited to neoprene, foam, rubber, or another elastomer.

The impact absorption mechanism on tread base 20 comprises four sets of cushioning members 52*a*-52*d* (eight cushioning member), which are secured to side frame members 28, 30 via brackets 54*a*-54*d*. Left side 44 and right side 46 of deck 42 rests on top of cushioning members 52 such that the cushioning members 52 are positioned at least partially between deck 42 and brackets 54, which may be considered part of base frame 26. Although FIG. 2 illustrates eight cushioning members 52, it is appreciated that various other numbers of cushioning members can be used. Cushioning members 52 dampen impact events by compressing during the impact event. Further, not all cushioning members 52 need have the same cushioning properties. For example, the four cushioning members 52*a*-52*b* toward the forward end 48 of deck 42 may be more compressible than the four cushioning members 52*c*-52*d* toward the rearward end 50 of deck 42.

Tread base 20 also includes a deck stiffening mechanism 56 that reduces the amount that deck 42 is able to move relative to base frame 26 during impact events. For example, deck stiffening mechanism 56 may reduce the amount that cushioning members 52 compress during impact events on deck 42. Deck stiffening mechanism 56 includes a pair of generally rigid members 58*a*, 58*b*. As will be discussed in more detail hereafter, a deck stiffening mechanism may have any number of generally rigid members, which can be positioned below a deck in any number of different locations. For example, one or more generally rigid members may be positioned near one or more impact absorption mechanisms on a treadmill. In treadmill 10, generally rigid members 58 are positioned between cushioning members 52*b* and 52*c*, near left side 44 and right side 46 of deck 42. Generally rigid members 58 may be constructed from any material that is resistant to compression, including metal, plastic, rubber, wood, a synthetic material, and the like.

Deck stiffening mechanism 56 also includes an engaging mechanism, which allows the generally rigid members 58 to be selectively engaged with and disengaged from deck 42. An engaging mechanism may include an elongated axle 60 that interconnects generally rigid members 58*a*, 58*b* such that movement of one generally rigid member results in corresponding movement of the other generally rigid member. Elongated axle 60 may extend below deck 42 and above the lower run of belt 38, as shown in FIG. 2, such that elongated axle 60 is positioned between deck 42 and belt 38. Alternatively, elongated axle 60 may extend below both deck 42 and belt 38. Elongated axle 60 and generally rigid members 58 are rotatable about an axis 62. Generally rigid members 58 extend radially away from axis 62 such that when elongated axle 60 is rotated, generally rigid members 58 are selectively engaged with or disengaged from deck 42.

Figure 3:
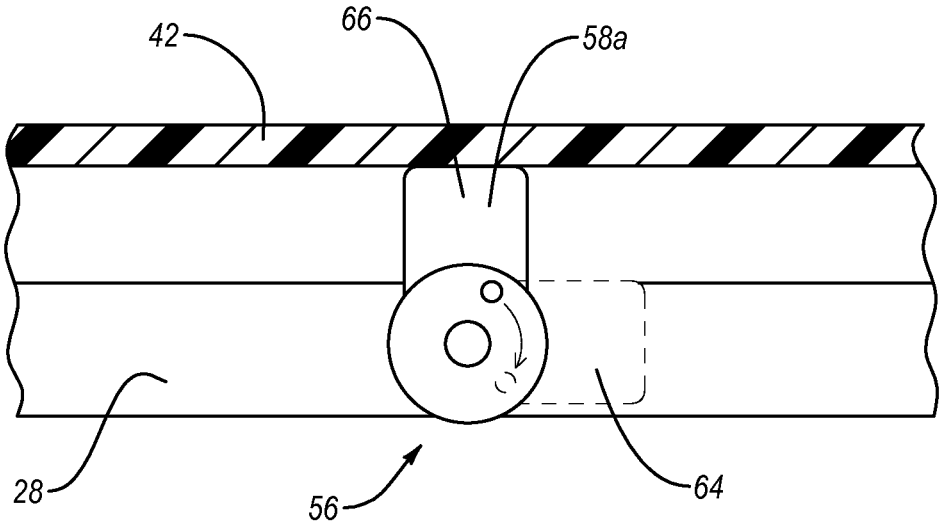
FIG. 3 is a side view of the deck stiffening mechanism illustrated in FIG. 1.

For example, FIG. 3 illustrates a partial side view of deck stiffening mechanism 56. Generally rigid members 58 are movable between a horizontal configuration 64 illustrated in phantom lines and a vertical configuration 66 illustrated in sold lines. When generally rigid members 58 are in horizontal orientation 64, they do not contact deck 42 during impact events. On the other hand, when generally rigid members 58 are in vertical orientation 66, they make contact with and provide support to deck 42 during impact events, thereby preventing deck 42 from moving downward toward base frame 26 during an impact event.

An engaging mechanism may also include a handle 68, which is mounted to right side frame member 28 and attached to generally rigid members 58 via axle 60. Handle 68 may be elongated, oval, round, square, or various other geometric shapes. Handle 68 may be anything that is easily graspable and rotatable by a user. Rotation of handle 68 selectively engages and disengages generally rigid members 58 with deck 42. As a user of treadmill 10 rotates handle 68, axle 60 translates the movement to generally rigid members 58. Consequently, all generally rigid members 58 in deck stiffening mechanism 56 move substantially simultaneously.

Deck 42 may also move relative to base frame 26 due to deflection in deck 42. This deflection or bending may occur between places where deck 42 is connected to base frame 26. For example, deflection in deck 42 may occur between forward end 48 and rearward end 50 of deck 42. Deflection or bending may also occur between left side 44 and right side 46 of deck 42. Several different factors may determine how much a deck deflects or bends during impact events. For instance, the construction of deck 42, including what deck 42 is made of, may affect the amount that deck 42 bends during an impact event. For example, if deck 42 is made from a material that is flexible (such as wood as opposed to steel), an increased amount of bending may be possible.

The manner in which deck 42 is attached to base frame 26 may also affect the amount that deck 42 bends during impact events. For example, the amount of deflection in deck 42 will increase as the distance increases between adjacent connection locations between deck 42 and base frame 26. Thus, in deck 42, some deflection may occur between the places where cushioning members 52*a*-52*d* support deck 42. This deflection may also occur between cushioning members 52 that are on opposite sides of deck 42 (i.e. between left side 44 and right side 46 of deck 42). This deflection may also occur between cushioning members 52 that are on the same side of deck 42.

Figure 4A:
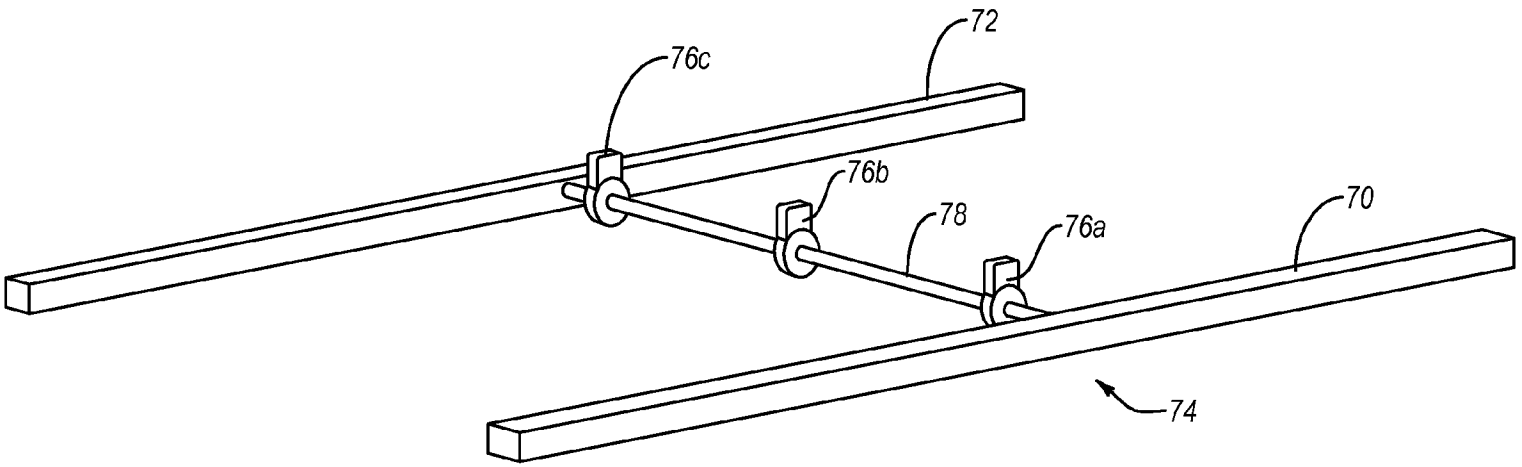
FIG. 4A is a perspective view of another deck stiffening mechanism according to the present invention.

To limit the amount of deflection or bending that occurs between left side 44 and right side 46 of deck 42, generally rigid members may be positioned so that, when engaged with deck 42, they provide support to deck 42 between its left side 44 and right side 46. For example, FIG. 4A illustrates a portion of a base frame and deck stiffening mechanism that may provide additional stiffening between left side 44 and right side 46 of a deck 42. As seen in FIG. 4A, the base frame includes a right frame member 70 and a left frame member 72, and a deck stiffening mechanism 74 extends between frame members 70 and 72. Deck stiffening mechanism 74 includes three generally rigid members 76*a*-76*c*, which are interconnected via an axle 78. In this embodiment, axle 78 and generally rigid member 76*b* would be positioned between deck 42 and belt 38. Generally rigid member 76*b*, when engaged with deck 42, provides support to deck 42 between its left and right sides 44, 46, thus reducing the amount of deflection between left and right sides 44, 46 of supported deck 42. Generally rigid member 76*b* may be positioned approximately equidistant from right frame member 70 and left frame member 72.

Figure 4B:
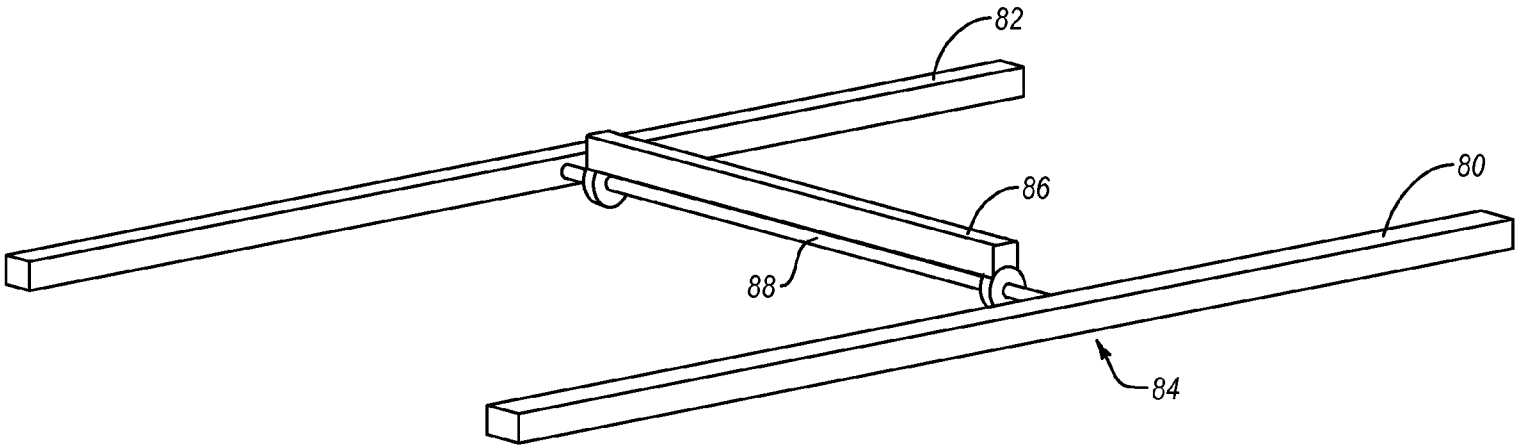
FIG. 4B is a perspective view of yet another deck stiffening mechanism according to the present invention.

FIG. 4B also illustrates a portion of a base frame and deck stiffening mechanism that may provide additional stiffening between left side 44 and right side 46 of a deck 42. As seen in FIG. 4B, the base frame includes a right frame member 80 and a left frame member 82, and a deck stiffening mechanism 84 extends between frame members 80 and 82. In this embodiment, deck stiffening mechanism 84 includes a single generally rigid member 86, which is attached to an axle 88. Generally rigid member 86 is configured to provide support to all or most of a deck between a left and right side. In this embodiment, as with the previous, axle 88 and generally rigid member 86 would extend between a deck and a belt. Rigid member 86, when engaged with the deck, provides support between a left and right side of a deck, thus reducing the amount of deflection between left and right sides of the supported deck.

Figure 5:
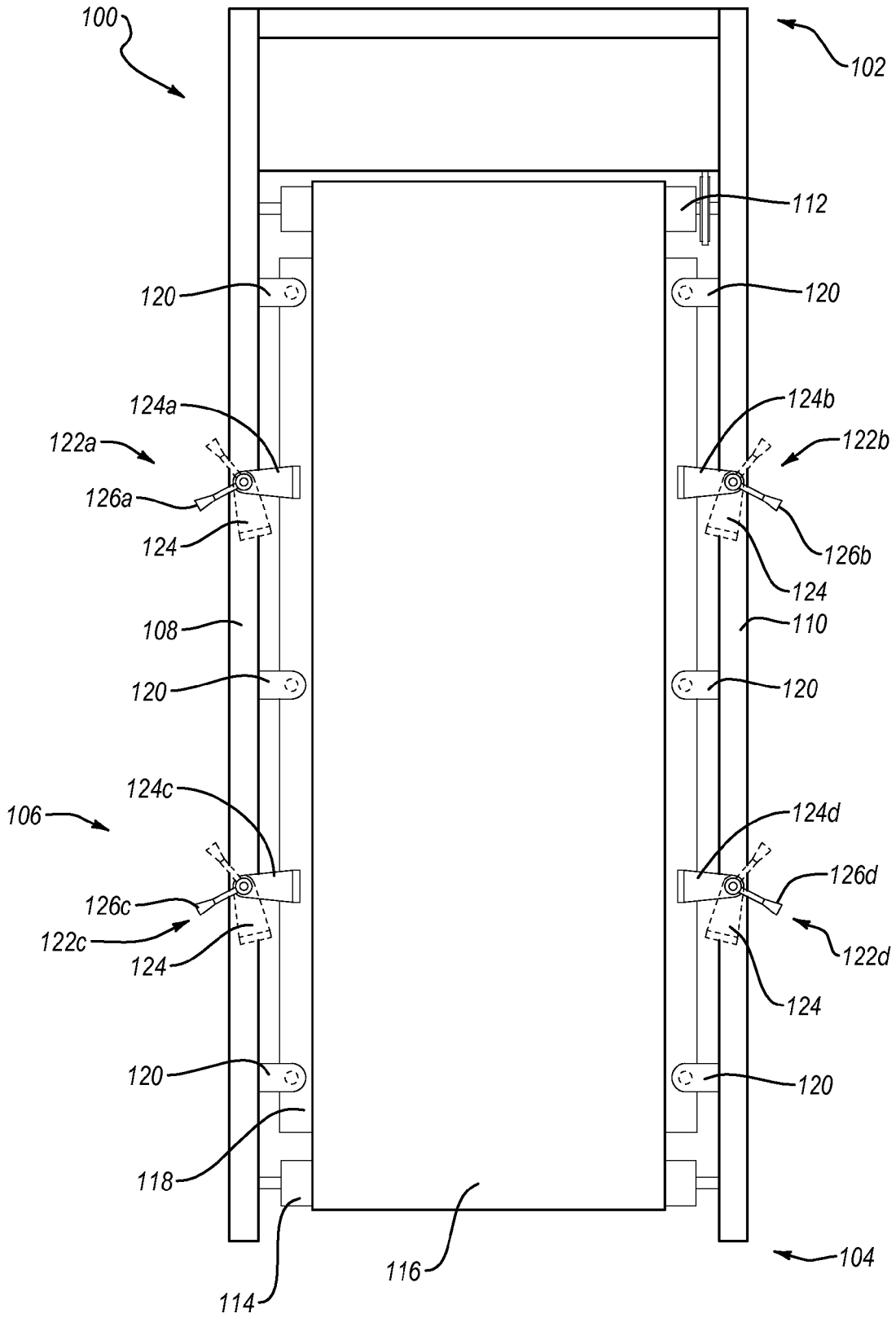
FIG. 5 is a bottom view of a treadmill with still yet another embodiment of a deck stiffening mechanism.

To limit the amount of longitudinal deflection of a deck occurring between places where a deck is secured to a tread base, additional deck stiffening mechanisms may be interposed between the contact points that connect the deck and the base frame. For example, FIG. 5 illustrates a bottom view of a tread base 100, which is similar to tread base 20 of FIGS. 1 and 2. For example, tread base 100 has a forward end 102, a rearward end 104, and a base frame 106 comprising a right side frame member 108 and a left side frame member 110. Tread base 100 also includes a front rotatable pulley 112, a back rotatable pulley 114, and an endless belt 116 that is trained over pulleys 112 and 114. Rotation of one or both of rotatable pulleys 112 and 114 may cause endless belt 116 to move. Tread base 100 also includes a deck 118 that provides support to an exercising user. Deck 118 is secured to base frame 106 via supports 120, which are secured to side frame members 108 and 110 and may be considered a part of base frame 106. Deck 114 may move relative to base frame 106 during impact events in order to cushion the impact events.

Tread base 100 includes four deck stiffening mechanisms 122*a*-122*d* that may reduce the amount that deck 118 is able to bend, deflect, or otherwise move relative to base frame 106 during impact events. Deck stiffening mechanisms 122 include generally rigid members 124*a*-124*d*, which are pivotally secured to right side frame member 108 and left side frame member 110. Generally rigid members 124 may be positioned below deck 118 and provide support thereto during impact events. Deck stiffening mechanisms 122 also include engaging mechanisms, which may selectively move general rigid members 124 into or out of engagement with deck 118. Specifically, generally rigid members 124 are movable between a nonengaged configuration illustrated in phantom lines and an engaged configuration illustrated in sold lines. When generally rigid members 124 are in the nonengaged configuration, they are not positioned under and do not contact deck 118 during impact events. On the other hand, when generally rigid members 124 are in the engaged configuration, they are positioned under, make contact with, and provide support to deck 118 during impact events.

Unlike deck stiffening mechanism 56 illustrated in FIGS. 1 and 2, generally rigid members 124 are not interconnected in deck stiffening mechanism 122. This embodiment would require a user to engage or disengage each deck stiffening mechanism 122 separately. Deck stiffening mechanisms 122 do not require rotation of a lever to engage or disengage. Rather, the engaging mechanisms on deck stiffening mechanisms 122 comprise levers 126*a*-26*d*, which a user may slide individually to engage or disengage generally rigid members 124.

Figure 6:
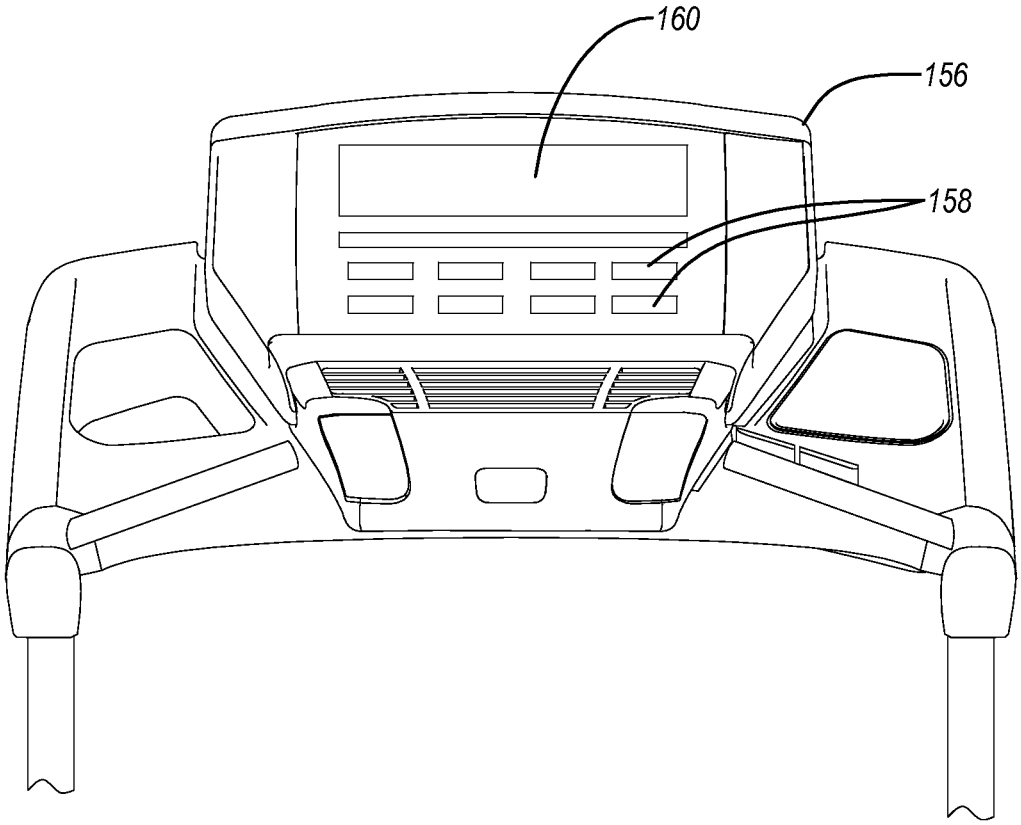
FIG. 6 is a perspective view of another deck stiffening mechanism according to the present invention.
Figure 6:
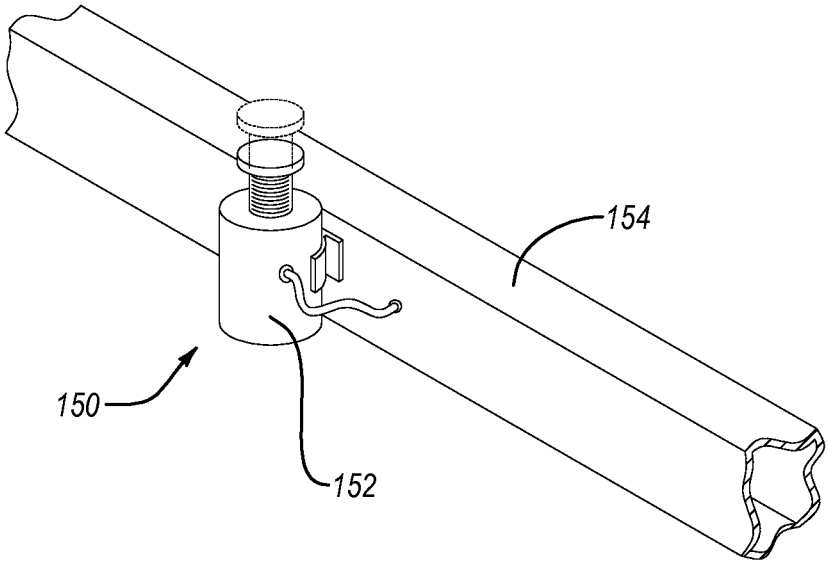

As stated previously, an engaging mechanism may be any mechanism that allows a user to selectively engage and disengage a deck stiffening mechanism. The engaging mechanism illustrated in FIGS. 1 and 2 includes a handle that a user may rotate. The engaging mechanism illustrated in FIG. 5 includes a lever that a user may slide. FIG. 6 illustrates a deck stiffening mechanism 150 with another possible engaging mechanism. Specifically, the engaging mechanism on deck stiffening mechanism 150 includes a motor 152, which is secured to a base frame 154. Motor 152 is in electrical communication with a control console 156. Motor 152 may comprise a screw motor or another device that extends an arm into a position where movement between a deck and base frame 154 is reduced or eliminated. Specifically, FIG. 6 shows motor 152 in a nonengaged configuration in solid lines and in an engaged configuration in phantom lines.

Control console 156 may include one or more input devices 158 that may be activated to cause deck stiffening mechanism 150 to engage and disengage a deck. Input devices 158 may comprise buttons, switches, rheostats, potentiometers, touch sensitive controls, voice activated controllers, and the like. Control console 156 may further comprise a display screen 160. Display screen 160 may include a video display, liquid crystal display (LCD), light emitting diodes (LEDs), cathode ray tube (CRT) display, electroluminescent display (ELD), gas-plasma display, thin film transistor (TFT) display, virtual reality (VR) display, and the like. Display screen 160 may include an indicator that alerts a user as to whether deck stiffening mechanism 150 is engaged or disengaged. For example, a light may be illuminated when deck stiffening mechanism is engaged. Alternatively, display screen 160 may display a symbol or wording to alert a user as to whether deck stiffening mechanism is engaged or disengaged.

INDUSTRIAL APPLICABILITY

In general, embodiments of the present disclosure relate to exercise devices having a deck stiffening mechanism that eliminate, in part or in whole, movement that occurs between a deck and a base frame in a treadmill. Movement between a deck and a base frame may or may not be desirable to a person performing an exercise on a treadmill. For example, movement between a deck and a base frame may provide a softened surface for walking, jogging, and running, which may help prevent leg and foot injuries. Movement between a deck and a base frame may not be desirable for a person who is using a treadmill to prepare for an outdoor event, as the softened surface may not realistically simulate the terrain on which the outdoor event is to take place. For example, for a person preparing for the Boston Marathon, a rigid deck may be desirable because is more realistically simulates the terrain to be encountered during the marathon.

Movement between a deck and a base frame may be caused by cushioning members that are positioned between a deck and a base frame. This movement between a deck and a base frame may also be caused by deflection or bending in a deck. Depending on how the deck is secured to the base frame, deflection of the deck may allow significant bending. For example, the deck may be secured to the base frame at only one end, leaving the other end to move freely. This configuration is similar to a diving board and may allow significant movement of the free end of the deck.

The deck stiffening mechanisms of the present invention eliminate, in part or in whole, this movement by selectively positioning one or more generally rigid members between the deck and the base frame. Any number of separate deck stiffening mechanisms may be positioned below a deck. Each deck stiffening mechanism may include one or more generally rigid members. These generally rigid members may be positioned anywhere below the deck. For example, the generally rigid members may be positioned toward the sides of the deck or somewhere in between.

Deck stiffening mechanisms may also include engaging mechanisms. An engaging mechanism may allow the generally rigid members to be selectively engaged with or disengaged from a deck. An engaging mechanism may include a handle, a knob, a lever, or the like that must be moved in a particular direction to engage or disengage the generally rigid members. Alternatively, an engaging mechanism may include a motor or another electronic device that selectively engages and disengages the generally rigid members, such as in response to a user input. The motor may include a screw drive, hydraulic drive, or another drive that selectively extends an arm member. A user input device may be located on a treadmill control console. The control console may also include a mechanism that signals to a user when the generally rigid members are engaged and disengaged. For example, a light, symbol, word, or words may be displayed to a user.

What is claimed is:

1. A treadmill comprising:

a base frame having a pair of side frame members;

a pair of rotatable pulleys secured to and extending between the side frame members;

an endless belt trained over the rotatable pulleys, the belt having an upwardly exposed exercise section;

a deck secured to the base frame, the deck providing support to the upwardly exposed exercise section of said belt;

an impact absorption mechanism operatively positioned at least in part between the deck and the base frame, wherein the impact absorption mechanism enables the deck to move relative to at least a portion of the base frame during impact events on the deck; and a selectively engageable deck stiffening mechanism that eliminates movement at a contact point between the deck stiffening mechanism and the deck during impact events on the deck, the deck stiffening mechanism comprising:

one or more generally rigid members and an engaging mechanism, wherein the engaging mechanism selectively engages the one or more generally rigid members with the deck to provide support to the deck during impact events on the deck; and wherein the impact absorption mechanism is configured to be incapable of contacting the contact point such that when the engaging mechanism selectively disengages the one or more generally rigid members from the deck, no support is provided at the contact point during impact events on the deck.

2. The treadmill of claim 1, wherein the impact absorption mechanism comprises one or more cushioning members.

3. The treadmill of claim 2, wherein the one or more cushioning members are made from rubber or foam.

4. The treadmill of claim 1, wherein the one or more generally rigid members are made of plastic, metal, or wood.

5. The treadmill of claim 1, wherein the deck stiffening mechanism comprises at least two generally rigid members.

6. The treadmill of claim 5, wherein the engaging mechanism comprises a handle and an axle that interconnects the at least two generally rigid members and the handle, wherein movement of the handle engages and disengages the at least two generally rigid members with the deck.

7. The treadmill of claim 6, wherein rotation of the handle selectively engages and disengages the at least two generally rigid members below the deck.

8. The treadmill of claim 1, wherein the deck stiffening mechanism comprises at least two independently operable generally rigid members.

9. The treadmill of claim 1, wherein the engaging mechanism comprises a motor in electric communication with an input device, wherein the one or more generally rigid members may be selectively engaged or disengaged in response to inputs received at the input device.

10. The treadmill of claim 9 further comprising a control console, wherein the input device comprises a button located on the control console.

11. The treadmill of claim 10, wherein the control console includes a display screen, the display screen displays an indicator, which provides an indication as to whether the one or more generally rigid members are engaged or disengaged with the deck.

12. The treadmill of claim 11, wherein the indicator comprises a light that illuminates when the one or more generally rigid members are engaged with the deck.

13. The treadmill of claim 11, wherein the indicator comprises a word or words that provide information regarding whether the one or more generally rigid members are engaged or disengaged with the deck.

14. The treadmill of claim 1 further comprising at least two deck stiffening mechanisms, wherein the deck stiffening mechanisms can be selectively engaged and disengaged independently of each other.

15. The treadmill of claim 1 further comprising a motor in mechanical communication with the pair of rotatable pulleys.

* * * * *